United States Patent [19]

Wangermann

[11] 4,083,461

[45] Apr. 11, 1978

[54] SYSTEM FOR STORING OF PRINTING PRODUCTS AND FOR TRANSPORTING THEM TO A TREATMENT MACHINE

[75] Inventor: Jochen Wangermann, Appen, Germany

[73] Assignee: Gruner + Jahr AG & Co., Hamburg, Germany

[21] Appl. No.: 705,719

[22] Filed: Jul. 15, 1976

[30] Foreign Application Priority Data

Jul. 18, 1975 Germany ..... 2532297

[51] Int. Cl.[2] ..... B65G 57/24

[52] U.S. Cl. ..... 214/8; 53/124 D; 206/386; 214/10.5 R; 214/309; 214/152

[58] Field of Search ..... 214/7, 8, 10.5 R, 301, 214/309, 15, 152; 53/124 D, 246, 255, 263; 206/386, 595, 596, 598; 294/67 BB, 34, 87 R; 312/35, 50

[56] References Cited

U.S. PATENT DOCUMENTS

| | | | |
|---|---|---|---|
| 2,503,562 | 4/1950 | Porter | 214/10.5 R |
| 3,228,166 | 1/1966 | Thiele | 53/124 D X |
| 3,400,843 | 9/1968 | Johnson | 214/309 |
| 3,682,329 | 8/1972 | Dean | 214/7 |
| 3,840,130 | 10/1974 | Wise et al. | 214/10.5 R |
| 3,982,642 | 9/1976 | Müller | 214/309 X |

FOREIGN PATENT DOCUMENTS

| | | | |
|---|---|---|---|
| 2,440,199 | 3/1976 | Germany | 53/124 D |

*Primary Examiner*—L. J. Paperner
*Attorney, Agent, or Firm*—Andrus, Sceales, Starke & Sawall

[57] ABSTRACT

A system for storing of printing products brought out from a printing machine and for transporting them to a further-treatment machine of the type wherein the printing products are kept in a compressed state by external forces within a staple during storage and transport and wherein the forces are reduced before the further-treatment. At least one rigid transport stand is provided for the reception of at least one staple. The staple is provided at each of its portions contacting the staple end faces with at least one groove opening towards the staple end face. Both the grooves extend parallel to each other and open to the outside of the transport stand. Movable gripping means with at least two spaced gripping fingers movable with respect to each other are provided. The gripping means is adapted to overlap a predetermined number of the printing products brought out from the printing machine and to keep the number compressed to such an extent that the gripping fingers may be introduced in the grooves, while the staple is clamped therebetween. The depth of said grooves and the space from each other allow a movement of the gripping fingers away from each other up to the sitting of the staple end faces upon the facing contact portions of the transport stand in such a manner that the staple is held in a compressed state between the contact portions.

19 Claims, 4 Drawing Figures

SYSTEM FOR STORING OF PRINTING PRODUCTS AND FOR TRANSPORTING THEM TO A TREATMENT MACHINE

BACKGROUND OF THE INVENTION

1. Field of the Invention

This invention relates to a system for storing of printing products brought out from a printing machine and for transporting them to a further-treatment machine of the type, wherein the printing products are kept in a compressed state by external forces within a staple during storage and transport and wherein the forces are reduced before the further-treatment.

2. Description of the Prior Art

With the production of books, newspapers, and job-type printing products it is necessary after the printing process to combine the single folded sheets brought out from the printing machine to the end product, as, for example, by means of collecting stitching or stapling machines or collecting machines. It is known to store the part-products brought out from the folding apparatus of the printing machine in bunches or staples on pallets in an unsecured manner. This is the most commonly used procedure. Further, it is known to bind the bunches or staples between small boards and to store them in this form on a pallet.

Further, a system of the above-described type is known, with which the staple is compressed between clamps and is transported together with the clamps to the further-treatment machine by means of transport devices.

In the daily use the above manners of storing and transporting have considerable disadvantages. First, the known systems can hardly be automated, since the compressed or uncompressed sheet staples stored on the pallet can only be positioned on said transport pallets unsufficiently. During the loading of the further treatment machines with the sheet staples manual work cannot be avoided, so that the further treatment is extensive with respect to manpower. Naturally, the same holds true for sheet staples supported on the transport pallets and being clamped by the clamps.

During the loading of the further treatment-machines with the staples not only the transport pallets are set free, but also the several auxiliary means, like boards, latching material and clamps, which are not connected to the transport pallets. Besides the pallets the auxiliary means, which may be still used again, have to be brought back to the folding apparatus of the printing machine and the auxiliary material which cannot be used again, has to be removed from the further treatment machines. The auxiliary material, which cannot be used again, leads to considerable additional costs.

Sheets, which are compressed or eventually only secured by the boards, are stacked one above the other on the transport pallets and care has to be taken that the part-staples are arranged one above the other in a brick-like manner to achieve at least a minimum of stability on said pallet. Normally, the pallets are transported by means of fork-lifts, so that a jerky and impact-like action on the staples cannot be avoided always.

A further disadvantage of the simple stacking of the part-staples one upon the other on said transport pallets resides in the fact that the lower layers of part-products are compressed to a considerably greater extent than the upper layers. This leads to a different forming of the folds of the sheets with the upper and the lower layers, respectively. The different state of folding, however, causes stopping actions in the further-treatment machines. The different folding state is a crucial obstacle in the production chain: printing machine-final product.

With the storing of products on pallets normally a plurality of pallets is stacked one upon the other due to reasons of the space available, the lower part of the upper pallet, however, presses on the layer of sheets on the pallet arranged under the upper pallet and may cause considerable damages. The use of special intermediate protection boards has not proved to be successful, since these boards would constitute a further flow of material. On the other hand, the damages caused by the feet of the upper pallet on the other layer of sheets on the lower pallet are often of such an extent that these sheets have to be sorted manually before the products stored on the lower transport pallet are loaded into a further-treatment machine. Even if a damaged sheet has been accepted by one treatment machine, this sheet may still cause a stopping action in another treatment machine, if the sheet or part-product treated in one machine has to be further treated in another treatment machine.

SUMMARY OF THE PRESENT INVENTION

The main object of the invention is to provide an improved system for storing of printing products brought out from a printing machine and for transporting them to a further treatment machine of the above-described type with which the backflow of handling material from the further-treatment machine back to the printing machine is as low as possible and easy to be handled and with which the stored and transported printing products are fed to the further-treatment machine in a faultless manner to the greatest possible extent.

Under "faultless manner" the exact positioning of the part-products as well as an exactly adjustable compression for all sheets is understood, the latter allowing — as already mentioned above — that each sheet is in the same state of folding.

The above is accomplished by the present invention by including at least one rigid transport stand for the reception of at least one staple which at each of its portions contacting the staple end faces is provided with at least one groove opening towards the staple end face, both said grooves extending parallel to each other and opening to the outside of said transport stand and by including at least one movable gripping means with at least two spaced gripping fingers movable with respect to each other, which gripping means is adapted to overlap a predetermined number of said printing products brought out from the printing machine and to keep that number compressed to such an extent that the gripping fingers may be introduced in said grooves, while said staple is clamped therebetween, and by providing said grooves with such depth and space from each other that a movement of the gripping fingers away from each other up to the sitting of said staple end faces upon the facing contact portions of the transport stand is possible in such a manner that said staple is held in a compressed state between said contact portions.

After bringing out a certain number of printing products from the printing machine, which number is determined by a measurement, preferably the weighing of the amount of paper, the movable gripping means overlap the staple formed by this number and compresses this staple. The sheet staple has in its compressed state a staple length which is somewhat smaller than the interior length of the transport stands. Thus, the gripping fingers with the staple clamped therebetween can be introduced into said grooves. When the staple has reached within the transport stand the position in which it is stored the staple is partly decompressed by moving the gripping fingers away from each other, until the staple end faces sit upon the associated contact portions of the transport stand. The staple is then held in a compressed state between these contact portions. Preferably, the contact pressure at the contact portions is of such a value that the staple is held between said contact areas without the provision of additional supporting elements. The gripping fingers of the gripping means can then be withdrawn from the grooves without endangering the clamping of the staple.

The filled transport stands may be — even stacked one above the other — stored. Thereafter, they can then be transported by means of automatic or manually controlled transport means to the further-treatment machine and can then be positioned in front of the further-treatment machine. Either the gripping means used for the loading of the transport stands is also brought to the further-treatment machine or another gripping means is associated to the further-treatment machine. The fingers of the gripping means are moved from each to such an extent and the gripping means is so positioned that the gripping fingers may enter into the grooves of the transport means in an unhindered manner. Thereafter, the fingers are moved towards each other and the staple is still further compressed until the contact between the contact portions of the transport stand and the staple end faces is substantially broken. Then the gripping means is withdrawn from the transport stand until the staple is free from the transport stand. It should be understood that there is also the possibility to move away the transport stand from the gripping means. The gripping means then conveys the staple towards the further-treatment machine and then by removing the gripping fingers from each other lays down the staple in or at the further-treatment machine, so that the further-treatment machine can withdraw the individual part-products from the staple in an unhindered manner.

Since the positioning of the individual staple with respect to the transport stand is always reproducible and exact, the production of a printing product starting from the printing machine up to the further-treatment machine, which combines the part-products to the final products, can be automated by means of proper transport devices. Except the transport stands no further auxiliary means has to be brought back from the further-treatment machine to the folding apparatus of the printing machine. There is no auxiliary material, which cannot be used again. Since the individual staples do not load each other, but are compressed between the walls of the transport stand or eventually rest on a support element, the part-products are not differently compressed, so that the folding state is also the same and thus reproducible.

To allow a secure gripping of one staple by the gripping means and to give the partly compressed staple within the transport stand a secure holding, the gripping means preferably includes two pairs of gripping fingers relatively movable with respect to each other and two pairs of grooves of said transport stand are associated to each staple.

Each transport stand includes as basic elements a bottom element and at least two opposing vertical side elements, in which said grooves are provided.

With a preferred embodiment the grooves or slots and the gripping fingers extend vertically and the transport stand is open at the upper side thereof. The loading and unloading of the transport stand is performed from its upper side. It should be understood that it is also possible that the grooves and gripping fingers extend horizontally and that the transport stand is at least open at one side thereof. This arrangement, however, has the disadvantage that the transport stands cannot be arranged side-by-side when they are loaded, but a certain free space has to be associated to each transport stand at the loading side thereof, in which free space the gripping means may operate.

Further, it is possible that staple support elements are provided within the transport element, which additionally support the loaded, partly compressed staples. It has to be stressed, however, that these additional supporting elements have not necessarily to be provided.

A especially simple construction of the transport stand is achieved, if the grooves are delimited by first bars arranged side-by-side in a spaced manner, which bars are connected to second bars lying outside and extending transversely to said first bars.

With such an embodiment preferably a protection board is arranged between both the groups of bars, which board prevents a soiling or damaging of the contents of the transport stand. A transport stand, which includes besides the two opposing vertical side elements still further two side elements opposing each other, is also covered by the present invention; such a transport stand naturally can only be loaded from above. Reference has to be made to the fact that the ratio of slit or groove width to the width of the contact portions lying at the sides of the grooves is selected such that a gripping of the staple by the gripping fingers of the gripping means as well as sufficient contact areas between the staple and the engaging elements during the holding of the partly compressed staple within the transport stand are provided. Preferbly, substantially equal engagement areas are selected between the staple and the gripping means at one hand and the transport stand and the staple on the other hand.

Further subclaims refer to advantageous embodiments of the invention.

DESCRIPTION OF THE DRAWINGS

The foregoing and other objects and features of the invention will become readily apparent from the following detailed description of preferred embodiments of the present invention when taken in conjunction with the appended drawings in which.

DETAILED DESCRIPTION OF PREFERRED EMBODIMENT

Figure 1:
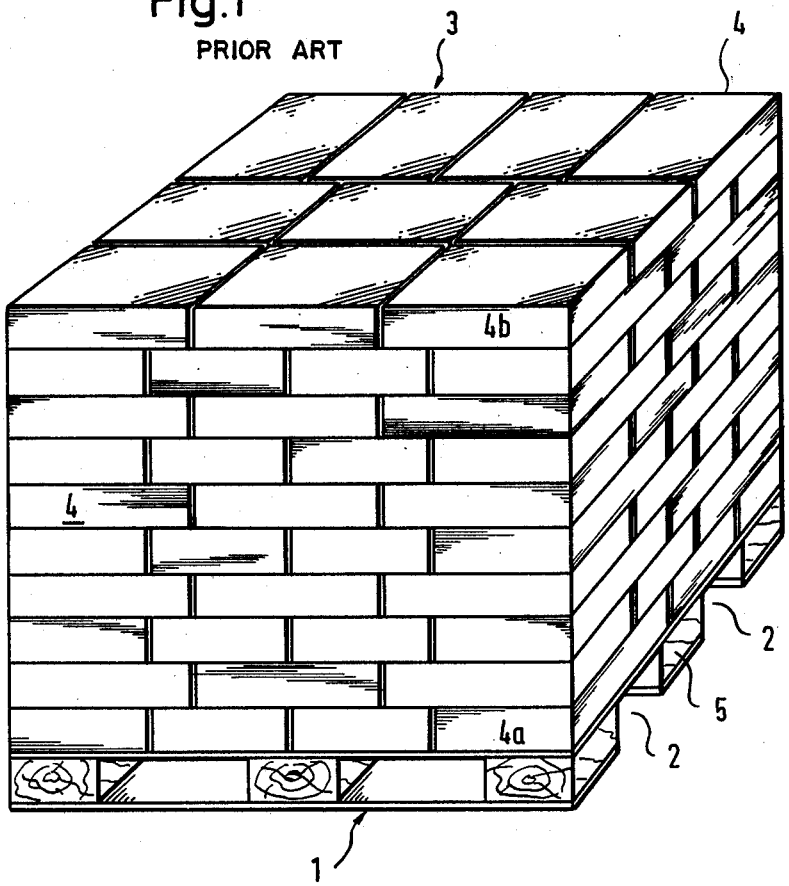
Fig.1 PRIOR ART
FIG. 1 illustrates the storing and transport arrangement commonly used to-day.

In FIG. 1 a transport pallet 1 is shown, which is used in the systems commonly used up to now. The pallet is provided with pockets 2, in which a transport device, especially the prong of a fork-lift may engage. To give the staples 3 loaded on the pallet the stability necessary for the transport, the individual part-staples 4 are arranged in a brick-like manner. As can be easily derived from FIG. 1, the layer with the part-staples 4a is compressed to a considerably higher extent than the layer with the part-staples 4b. The sheets of the part-staples 4a do therefore have a more sharply formed fold than the sheets of the part-staples 4b. Since the staples 4 are manually loaded on pallet 1, the weight of the part-staples 4 cannot surmount a certain value. The upper sheets of the part-staples 4b can easily be damaged by the feet 5 of an overlying pallet, when a plurality of pallets 1 are stacked. Such a damage can also not be avoided, if the individual part-staples 4 or the total staple 3 are tied up.

Figure 2:
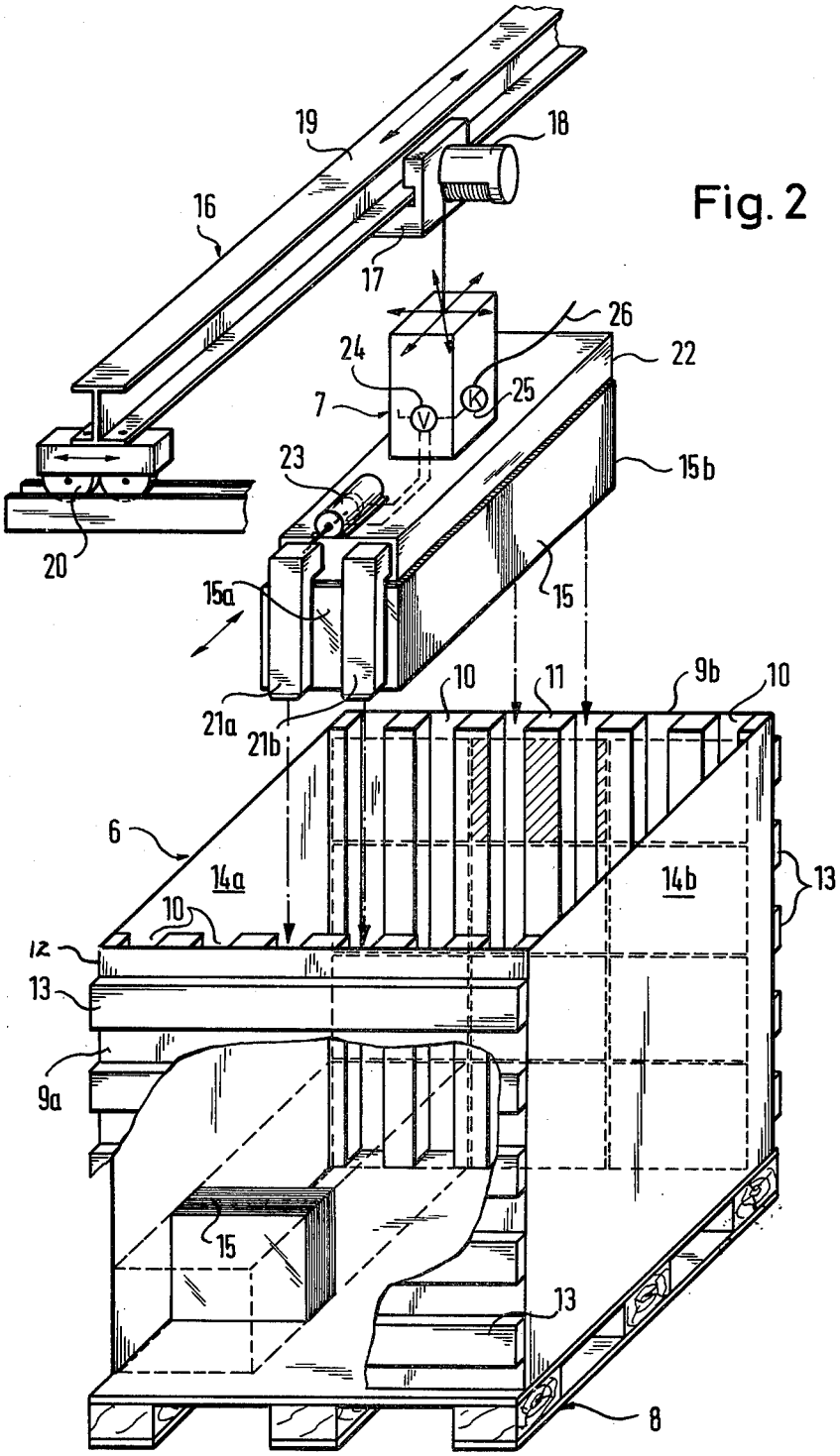
FIG. 2 illustrates a first embodiment in accordance with the principles of the present invention and FIGS. 3*a* and 3*b* illustrate a second embodiment in accordance with the principles of the present invention.

FIG. 2 shows the two substantial components of the system according to the principles of the invention, namely a rigid transport stand 6 and a movable gripping device 7.

The transport stand 6 includes a bottom element 8 comparable to the pallet 1 of FIG. 1, which bottom element is also provided with pockets for the engagement of the prongs of a fork-lift. Further, the transport stand 6 includes two vertical side elements 9a and 9b arranged opposite to each other. In the side elements 9a and 9b slots or grooves 10 are provided.

With the embodiment shown in FIG. 2, each of the elements 9a and 9b is made up by a row of spaced vertical bars 11, a protection board 12 and a group of horizontally extending bars 13 lying on the outside of the protection board 12. By connecting the bars 11 through the protection board to the bars 13 an utmost rigid construction of the side elements is achieved, while simultaneously the grooves 10 important for the transport stand 6 are formed in a very simple manner. To increase the rigidity and to protect the part-products (signatures) to be loaded into the transport stand 6, the two side elements 9a and 9b are connected by a further pair of opposing side elements 14a and 14b. As shown by the dashed lines on side element 9b in FIG. 2, the shown transport stand is to serve the reception of 12 staples 15. The staple end face 15b facing the side element 9b, contacts the portions being hatched in FIG. 2, i.e. the staple end face 15b contacts the back face of one bar and substantially the half back faces of the adjacent bars. Thus, two grooves 10 open towards each staple end face.

The movable gripping device 7 is movable in all three directions of space as shown by the arrow system in FIG. 2. The gripping device is part of a lifting transport apparatus 16, which is shown in FIG. 2 schematically only. The lifting transport apparatus includes a crane trolley 17 with hoist 18, which trolley is movable in the direction of the shown arrow along a beam 19. The beam 19 is movable transversely to its direction of extension by means of a running mechanism of which only a trolley 20 and a beam supporting said trolley is shown. Besides the lifting transport apparatus 16 an apparatus of another type can be used, which, for example, uses instead of the rope rigid guiding elements being displaceable with respect to each other.

The gripping device includes two pairs of gripping fingers relatively movable with respect to each other. In the perspective representation of FIG. 2, only the gripping fingers 21a and 21b on one side of the gripping device are shown, which gripping fingers co-operate with the staple end face 15a. Comparable gripping fingers co-operate with the staple end face 15b. The gripping fingers 21a and 21b can slip out from the housing 22 of the gripping devide 7 to a certain extent and can be withdrawn into said housing to vary the gripping length between the two pairs of gripping fingers. For the movement of the gripping fingers there are several different possibilities. In FIG. 2 a piston/cylinder drive 23 for the movement of the gripping finger 21a is shown, which can be biased by a switching valve 24 from a only schematically shown compressor 25. The compressor 25 can be provided with current over a flexible conductor 26. A similar piston/cylinder drive may be associated to gripping finger 21b. There is, however, the possibility that one and the same drive operates on both the gripping fingers.

It should be understood that it is possible that the gripping fingers of both pairs may be moved with respect to the housing 22. It is sufficient, however, if only the gripping fingers of one pair are movable relative to said housing, while the gripping fingers of the other pair are rigidly connected to the housing 22.

During the operation of the inventive system the lifting transport apparatus 16 moves the gripping device 17 to the outlet end of a not shown folding apparatus. If a predetermined number of part-products has left the folding apparatus, these part-products are overlapped by the gripping device 7 from above and the gripping fingers 21a and 21b are moved towards the gripping fingers of the other pair of gripping fingers so that the part-products are compressed into one staple and may be held by the gripping device. Then the lifting transport apparatus 16 moves the gripping device 7 over a prepared empty transport stand 6 in such a manner that the gripping fingers on each side of the gripping device 7 are exactly positioned over two grooves or slots 10. By actuation of the hoist 18 the gripping device is now lowered so that the gripping fingers may enter the associated grooves. By the forces applied by the gripping fingers onto the staple 15 the length of the staple is decreased to such an extent that it is smaller than the free width of the transport stand 6. With the configuration shown in FIG. 2 a new staple 15 is laid down besides the staple already laid down on the bottom element 8 of the transport stand 6. When the staple 15 is lying on the upper side of the bottom element 8 the gripping fingers 21a and 21b are moved away from the gripping fingers of the other pair. This is possible due to the selected depth of the grooves 10 and the space of the grooves from each other in the side elements 9a and 9b. When the gripping fingers 21a and 21b are moved the staple 15 partly de-compresses until the staple end faces 15a and 15b sit onto the associated contact portions of the side elements 9a and 9b, respectively.

If three staples 15 are laid down on the upper side of the bottom element 8, upon bringing forward of the next staple 15 by the gripping device 7 and the lifting transport device 16 the gripping device 7 is lowered by the hoist 18 down into the transport stand only to such an extent that the lower side of the staple 15 does not sit on the upper side of the staple already brought into the transport stand. Upon the removal of the gripping fingers 21a and 21b the staple is only partly decompressed to such an extent that the frictional forces between the individual folded sheets within the staple 15 and the frictional forces at the contact portions with the side elements 9a and 9b are sufficiently high to hold the newly brought up staple in a partly compressed state between the side elements 9a and 9b without the newly added staple 15 supporting itself on a staple 15 already stored in the transport stand 6. In this manner the transport stand 6 can be filled with staples one by one. The staples 15 brought into the transport stand are protected from all sides and when the filled transport stands are stacked one above the other a damaging of the upper layers is not possible, since the feet of the bottom element 8 support on the free end faces of the bars 11.

It should be understood that there are systems possible, with which the transport stand 6 is relatively moved with respect to the gripping device 7, when the transport stand 6 is filled. The lifting transport apparatus 16 then needs less directions of movements. It is only of importance that the relative movements between the gripping device 7 on one hand and the transport stand 6 on the other hand are possible.

The filled transport stand is either transported to a store room or store house or is directly transferred to a further-treatment machine (not shown). The gripping device 7 is either moved to the further-treatment machine or a comparable gripping device is associated to the further-treatment machine. When the treatment machine is to be loaded with a staple stored within the transport stand 6 the gripping fingers of the gripping device are brought in their widest possible gripping position and then introduced into the grooves. Thereafter, the gripping fingers of both the pairs of gripping fingers are moved towards each other so that the staple can be again compressed to a greater extent. In doing so the frictional engagment between the contact portions of the side walls 9*a* and 9*b* is broken up so that the staple 5 can be lifted from the transport stand unhindered. The lifting apparatus 16 now moves the gripping device 7 to the further-treatment machine and lowers the staple 15 and de-compresses it.

Thereafter the gripping device is withdrawn from the staple.

Figure 3B:
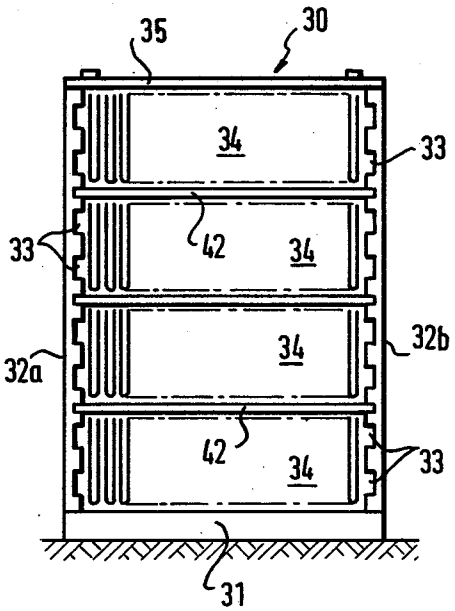
Figure 3A:
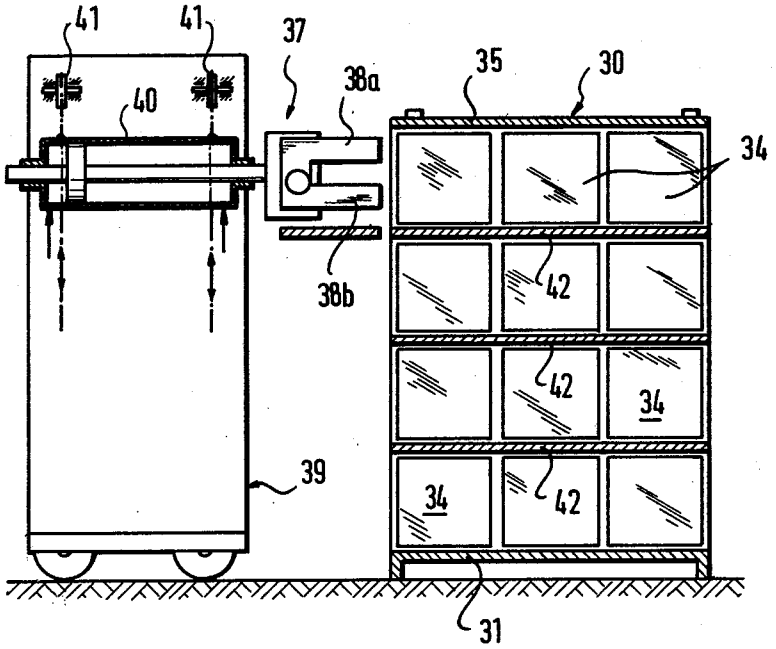

In FIGS. 3*a* and 3*b* a further embodiment of the system is shown. The transport stand 30 again includes a bottom element 31 and two vertical side walls or side elements 32*a* and 32*b*. Grooves 33 are cut on the insides of the side elements 32*a* and 32*b*. The transport stand 30 is adapted to receive 12 staples 34. In each of the side elements 32*a* and 32*b*, respectively, two grooves 33 are associated to each staple 34, so that the contact portion has substantially the same configuration as with the embodiment according to FIG. 2. In contrast to the embodiment according to FIGS. 3*a* and 3*b*, the transport stand is, however, closed to the top side by a covering member 35 and a gripping device 37 loads the transport stand from one side. The FIG. 3*a* shows a section through the transport stand 30 along a plane parallel to the loading direction, whereas FIG. 3*b* shows a side view of the transport stand viewing in the direction of loading.

The gripping device 37 shown with the gripping fingers 38*a* and 38*b* of the one gripping finger pair is shown in side elevation and is (with the embodiment according to FIGS. 3*a* and 3*b*) part of a floor level transport apparatus 39, the construction of which is shown schematically. A piston/cylinder drive 40 allows the forward movement of the gripping device 37 into the transport stand 30, while the shown supporting mechanism 41 allows the lifting and lowering of the gripping device, as shown by the double-headed vertical arrows along non-referenced chains guided over non-referenced pulleys. The winding up and unwinding of the chains, ropes etc. is achievable with conventional means. The lifting and lowering of the piston/cylinder drive 40 may also be achieved by hydraulic or pneumatic means. The two operation chambers of the piston/cylinder drive 40 may be biased as shown by the single-headed arrows.

With the transport stand 30 shown in FIGS. 3*a* and 3*b* supporting elements 42 are provided to support the individual staples and to separate them from each other. These supporting elements may be necessary, when, for example, the surface characteristics of the web material used for the printing does not allow in the partly de-compressed state the build-up of the interior frictional forces necessary for a free clamping of the staple between the side elements 32*a* and 32*b* or for the frictional forces at the contact portions with the side elements 32*a* and 32*b*, respectively, themselves. It must be stressed, however, that such supporting elements are usually not necessary, when normal paper webs are handled as outlined in connection with FIG. 2.

After the description of two possible embodiments of the system according to the invention the most important features thereof shall again be outlined:

1. A staple of folded part-products is compressed by a gripping device to such an extent that the staple can be brought into a rigid transport stand in an unhindered manner.

2. The staple is partly de-compressed in said transport stand by actuation of the gripping device so that the staple remains within the transport stand in a partly de-compressed state and the gripping device can be withdrawn.

3. For the movement of the gripping device and the movement of the transport stand transport devices of most different types can be used so that the system can be part of an automated production process between the printing machine and the machine processing the final product.

Further, it should be noted that it is also possible that the side elements provided with grooves can be manufactured by forming plane metal sheets to wavy metal sheets, the wavy configuration being eventually also a square one. To increase the rigidness of these side elements, two of such metal sheets can be spot-welded to such a configuration, which corresponds to the configuration with horizontal and vertical bars.

Finally, it has to be stressed that the grooves and the gripping fingers need not to have a square cross-section. Further, it is possible that the transport stand of the present invention may be loaded from above as well as from one side thereof, if a corresponding side element configuration with crossing grooves is used. This and other configurations of the transport stand are to be covered by the present invention as long as the transport stand allows an operation according to the above remarks (1) to (3).

I claim:

1. A system for storing and transporting a plurality of staples of aligned sheet-like products compressible in the direction of alignment, said system comprising:

at least one rigid transport stand (6; 30) having an open end and a pair of spaced side walls (9*a*; 9*b*) lying normal to the plane of said open end, said side walls being abuttable with end faces of the staples for receiving at least one staple of said products therebetween and for compressing the staple in the direction of alignment by an amount sufficient to establish the staple as a self-supporting body within said stand and to retain the staple between said walls at a designated location, the portion of each of said side walls in abutment with the staple end faces being provided with at least one groove (10; 33) opening toward the staple end face and along the open end of said transport stand, said grooves extending parallel to each other in said side walls; and gripping means (7; 37) relatively moveable with respect to said transport stand, said gripping means having at least one pair of spaced, opposed gripping fingers (21*a*, 21*b*; 38*a*, 38*b*) adapted to be introduced into said grooves in said transport stand side walls, motive power means (23) coupled to said gripping fingers and moving said fingers toward and away from each other for engaging a staple to compress it by an amount greater than the compression exerted by said side walls for providing cohesion to the staple in said gripping means and to permit the gripping fingers to be introduced into said grooves (10).

2. The system according to claim 1, characterized in that said gripping means (7; 37) includes two pairs of gripping fingers (21*a*; 21*b*; 38*a*, 38*b*) relatively movable with respect to each other, and in that two pairs of grooves (10; 33) of the transport stand are associated to each staple.

3. The system according to claim 1 characterized in that said support stand (6; 30) includes a bottom element (8; 31) between said spaced side wall.

4. The system according to claim 1, characterized in that said grooves (10) and the gripping fingers (21*a*, 21*b*) extend vertically, and in that the transport stand (6) is open at the top side thereof.

5. The system according to claim 1, characterized in that said grooves (33) and said gripping fingers (38*a*, 38*b*) extend horizontally, and in that the transport stand is at least open to one side thereof.

6. The system according to claim 1, characterized in that support elements (42) are provided in said transport stand, which support elements additionally support the loaded compressed staples (34).

7. The system according to claim 1, characterized in that said grooves (33) are cut in side walls formed from solid material.

8. The system according to claim 1, characterized in that said grooves (10) are delimited by first bars (11) spaced from each other and arranged side-by-side, which first bars are connected to second bars (13) arranged at the outside of said transport stand and extending transversely with respect to the first bars.

9. The system according to claim 8, characterized in that between both the groups of bars (11, 13) protection board (12) is arranged.

10. The system according to claim 1, characterized in that said side elements include at least one wavy metal sheet.

11. The system according to claim 10, characterized in that two wavy metal sheets with the waves extending perpendicular to each other are connected to form one side element.

12. The system according to claim 1, characterized in that said gripping means (7) is part of a lifting transport means (16).

13. The system according to claim 1, characterized in that said gripping means (7) is part of a floor transport means (39).

14. The system according to claim 1, characterized in that the transport stand is provided at least at two side elements with grooves crossing each other.

15. A rigid support stand for a plurality of staples of aligned sheetlike products compressible in the direction of alignment, said stand comprising:

a base member;

a pair of opposed, spaced side wall members mounted on said base member, said side walls being abuttable with end faces of the staples for receiving at least one staple of said products and for compressing the staple in the direction of alignment by an amount sufficient to establish the staple as a self-supporting body within said stand for retaining the staple between the walls, said side walls containing recess means suitable for receiving means for introducing and removing the staple between said side walls.

16. A method for storing and transporting staples of aligned sheet-like products compressible in the direction of alignment, said method comprising:

orienting a staple so the direction of alignment is generally horizontal;

applying a compressive force to the staple in the direction of alignment sufficient to establish the staple as a self-supporting body at a location;

retaining the staple in the self-supporting condition for storage purposes;

compressing the staple by an amount greater than that necessary to establish the staple as a self-supporting body; and transporting the staple with respect to the location.

17. The method according to claim 16 further defined as transporting the staple vertically with respect to the location.

18. The method according to claim 16 further defined as transporting the staple horizontally with respect to the location.

19. The method according to claim 17 further defined as establishing a plurality of staples as self-supporting bodies at locations proximate with respect to each other.

* * * * *